United States Patent [19]

Hartman

[11] 3,938,802

[45] Feb. 17, 1976

[54] SHEET STACKING APPARATUS

[75] Inventor: Robert E. Hartman, Macedon, N.Y.

[73] Assignee: Xerox Corporation, Stamford, Conn.

[22] Filed: Aug. 19, 1974

[21] Appl. No.: 498,691

Related U.S. Application Data

[63] Continuation of Ser. No. 319,956, Dec. 29, 1972, abandoned.

[52] U.S. Cl. ..... 271/220; 271/173

[51] Int. Cl.[2] ..... B65H 31/36

[58] Field of Search ..... 271/224, 223, 220, 221, 271/222, 173, 64

[56] References Cited

UNITED STATES PATENTS

| | | | |
|---|---|---|---|
| 1,891,286 | 12/1932 | Miersch | 271/222 X |
| 2,990,174 | 6/1961 | Kimbrough | 271/173 UX |
| 3,358,993 | 12/1967 | Lytle | 271/224 |

*Primary Examiner*—Evon C. Blunk
*Assistant Examiner*—Bruce H. Stoner, Jr.

[57] ABSTRACT

This invention relates to a sheet stacking apparatus for stacking sheets into inclined trays moved past a sheet discharge zone. The trays each have first and second tray portions which are inclined to the horizontal and vertical, respectively, to enable a nested configuration. A pair of vertically extending stacking members are positioned adjacent to the sheet discharge zone to form an acute angle with the first tray portion of the receiving tray. The stacking member is pivotally mounted such that as a sheet enters the tray the kinetic energy of the sheet is converted to rotational kinetic energy. As the stacking member returns to its normal position, its rotational kinetic energy acts upon the topmost portion of the stack of sheets in the tray rather than upon a single top sheet. As a result the top sheet is not moved relative to the tray. As the stack height increases, the acute angle decreases to effect a stacking arrangement of the sheets' edges against the second tray portion.

2 Claims, 12 Drawing Figures

SHEET STACKING APPARATUS

This is a continuation of application Ser. No. 319,956 filed Dec. 29, 1972, now abandoned.

This invention relates to a sheet stacking apparatus for stacking sheets into trays as for example, sorter trays receiving copies from a reproduction system into collated sets.

With advent of high speed copier/duplicator systems there has been a growing concern for the distribution and handling of the copy sheets in a collated fashion. In the past sheet distribution systems have included stacking by rotating or moving a housing carrying bins or trays past a copy sheet path as described in U.S. Pat. Nos. 2,876,008, 2,951,697 3,076,647, and 3,561,754. Depending upon the tray arrangement for receiving the sheets, there is an associated problem for stacking of the sheets into a neat pile to facilitate unloading of the stacks and also to maximize the number of sheets that may be received.

The present invention is, generally speaking, an improved stacking apparatus for enhancing reliability in producing sets of sheets received in bins or trays for rapid distribution and unloading of copy sheets in collated sets.

It is therefore a general object of this invention to improve the distribution and unloading of copy sheets.

It is another object of this invention to enable the distribution and unloading of copy sheets in collated sets in a reliable manner.

It is still a further object of the invention to eliminate the bouncing and/or skewing of sheets received in a tray.

It is still a further object of the invention to achieve sorting of copy sheets into a tray configuration which is simple and compact in construction.

The above and added advantages of the present invention will be more apparent after reading the following detailed description which refers to accompanying drawings in which.

Figure 7:
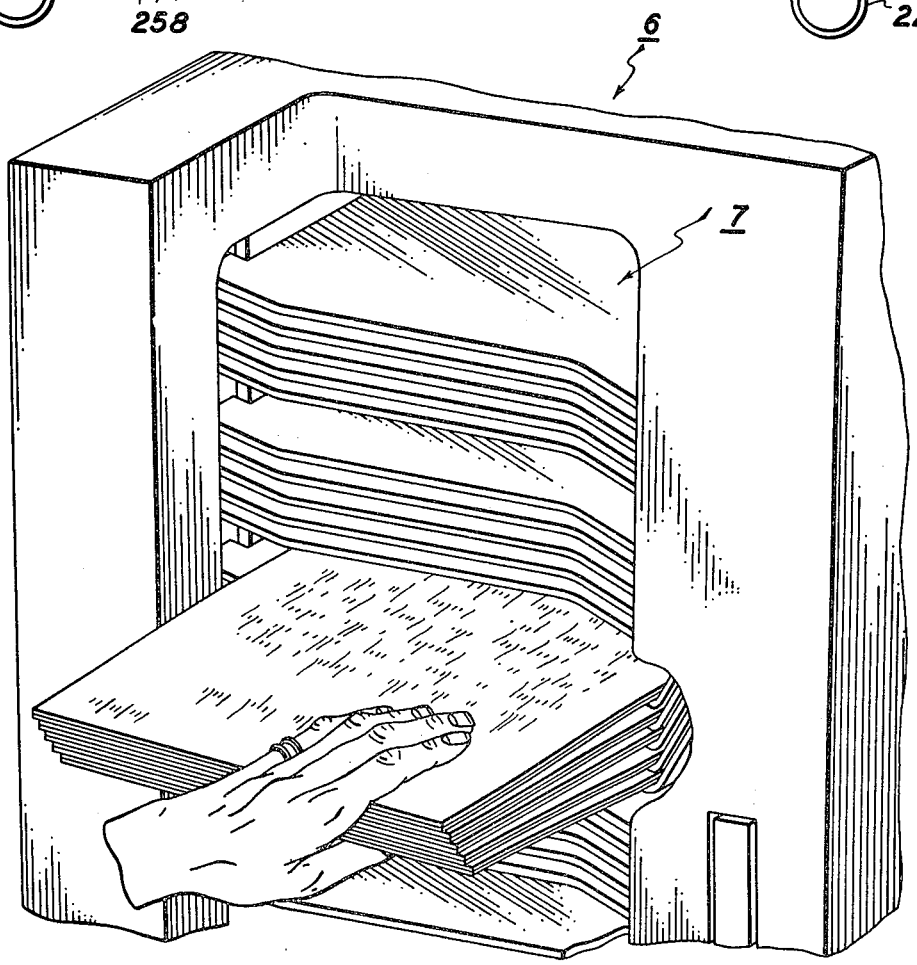
Figure 5A:
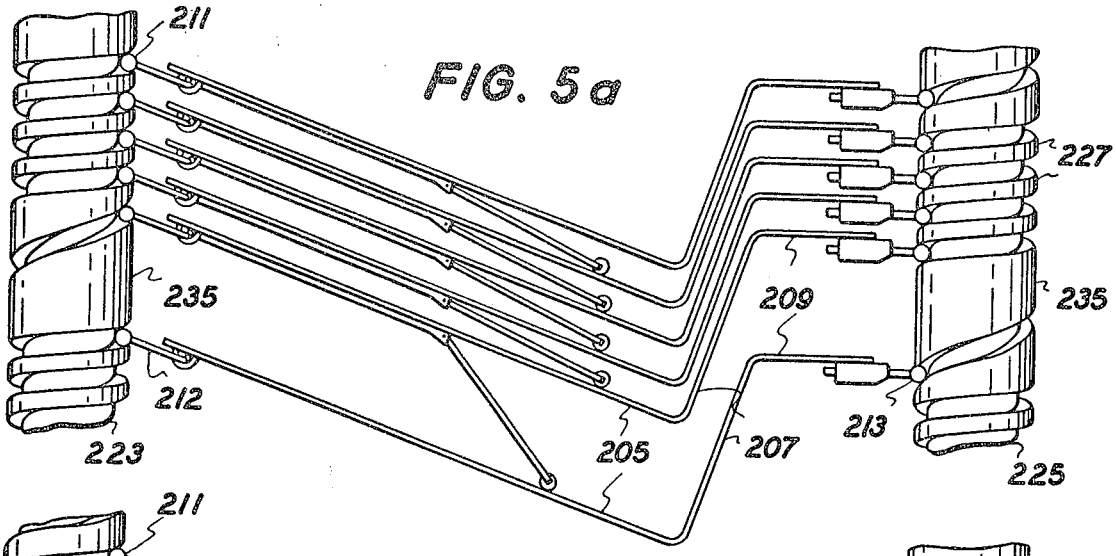
Figure 5B:
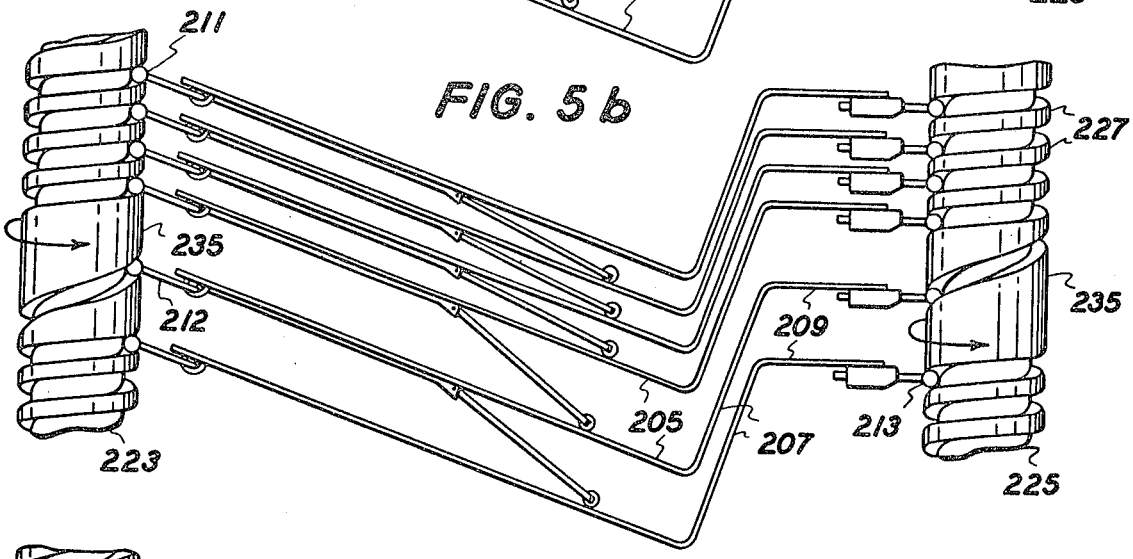
Figure 5C:
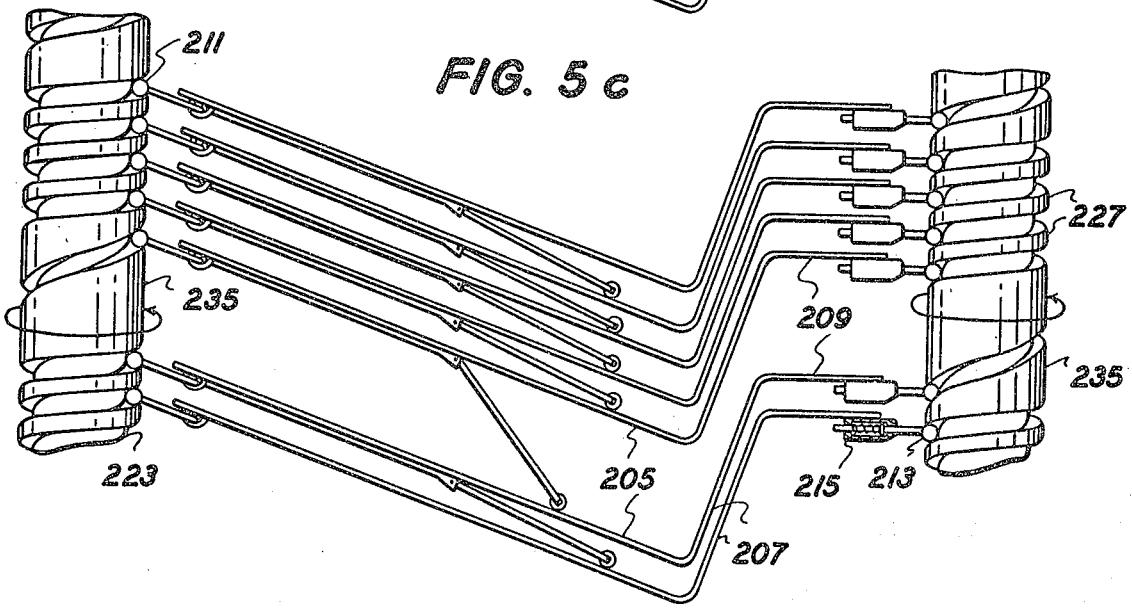
Figure 6:
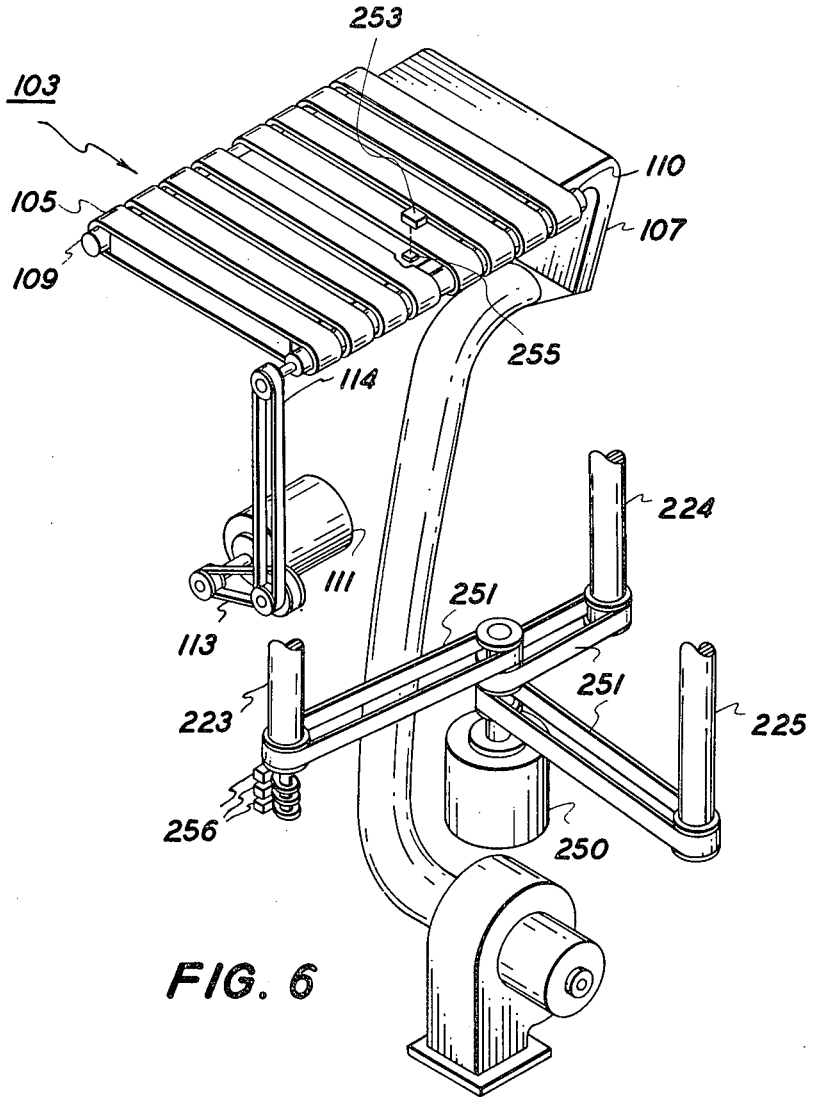
Figure 8:
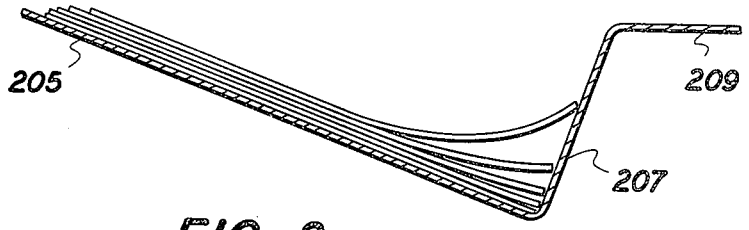
Figure 9A:
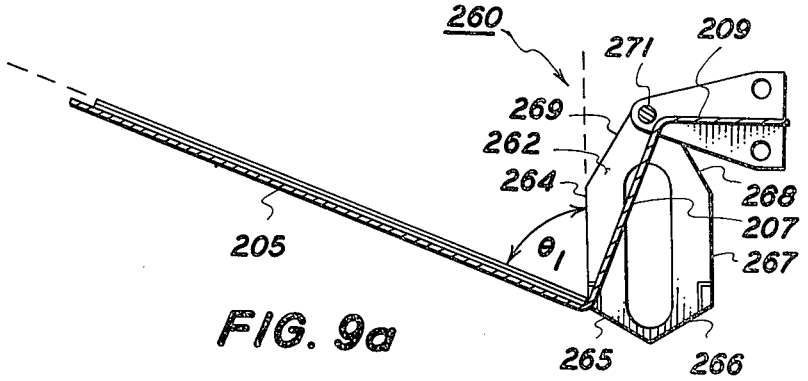
Figure 9B:
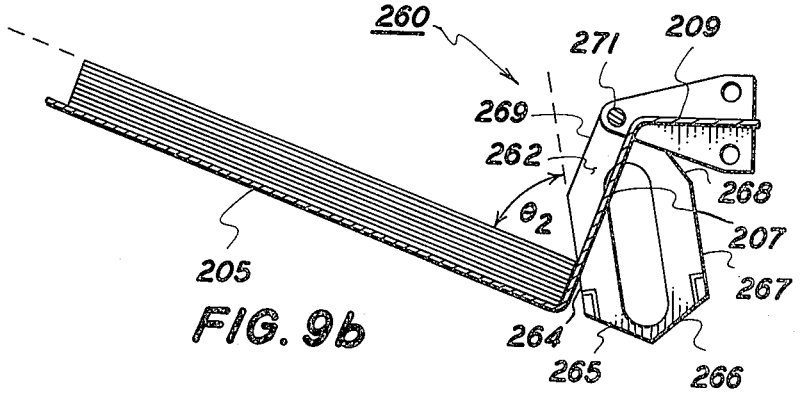

FIGS. 5*a–c* are exploded views of the tray assemblies illustrating details of the opening tray operation;

FIG. 6 is an isometric view of the drive assembly for the sorter/collator apparatus;

FIG. 7 is an exploded view of the tray illustrating set separation upon unloading;

FIG. 8 is a side view illustrating a tray assembly without the stacking apparatus of the invention, and FIG 9*a* and 9*b* are side views illustrating a tray assembly with a stacking apparatus of the invention in an empty condition and in a loaded condition, respectively.

Figure 1:
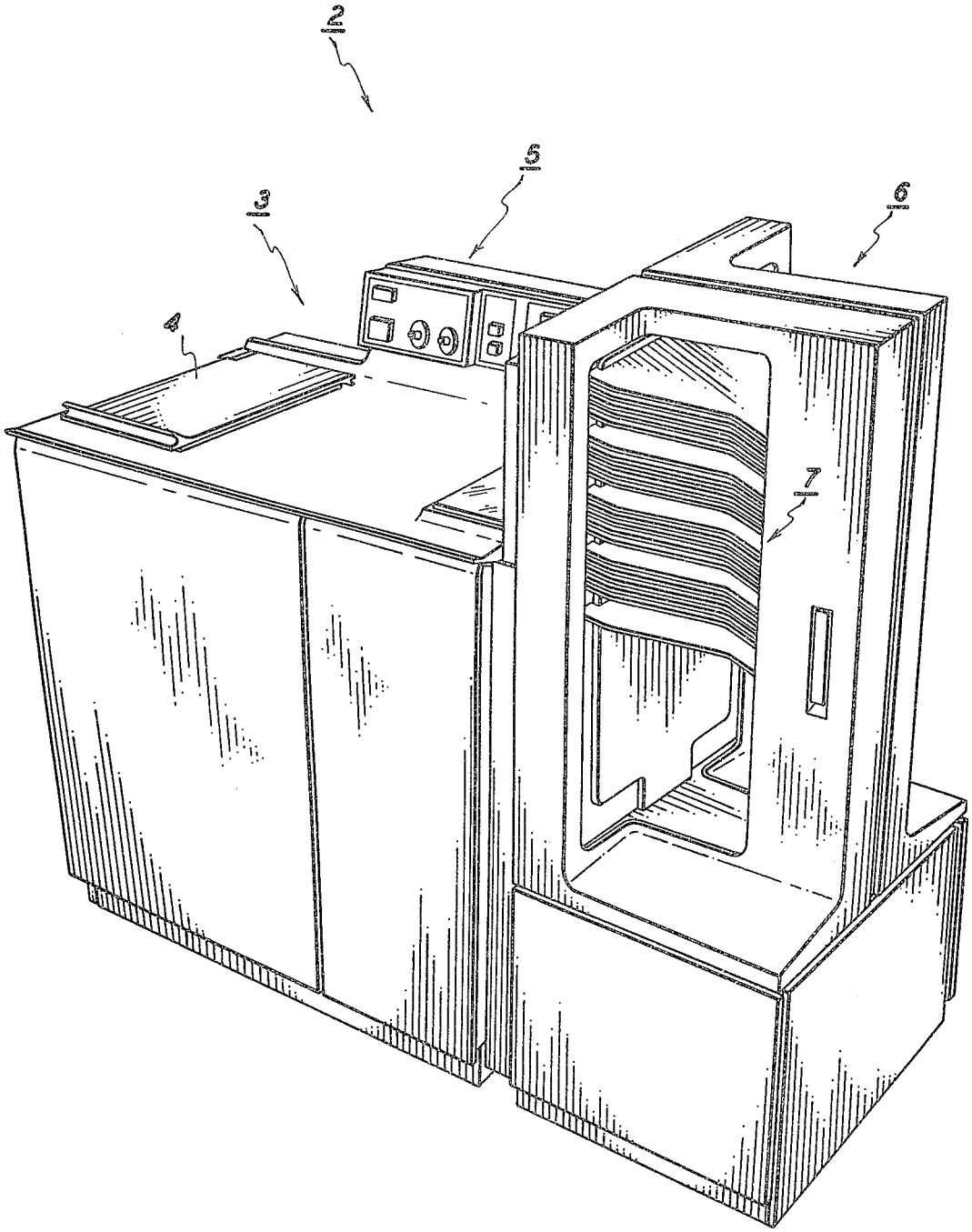
FIG. 1 is a perspective view of a high speed copier/duplicator system including a sorter/collator apparatus having sheet stacking apparatus according to the present invention.

FIG. 1 shows a copier/duplicator system generally designated 2 including a copier machine 3, which is a high speed copier/duplicator capable of producing simplex or duplex copies at the option of a machine operator. The copier machine 3 has a platen 4 for receiving documents to be reproduced, and a control panel 5 which includes various control knobs, buttons, and switches for selecting various modes of operation such as simplex and duplex copies and the number of copies to be reproduced. In accordance with the invention, the copier/duplicator system includes a sorting apparatus 6 having tray assemblies 7 and a sheet stacking apparatus 8.

Figure 2:
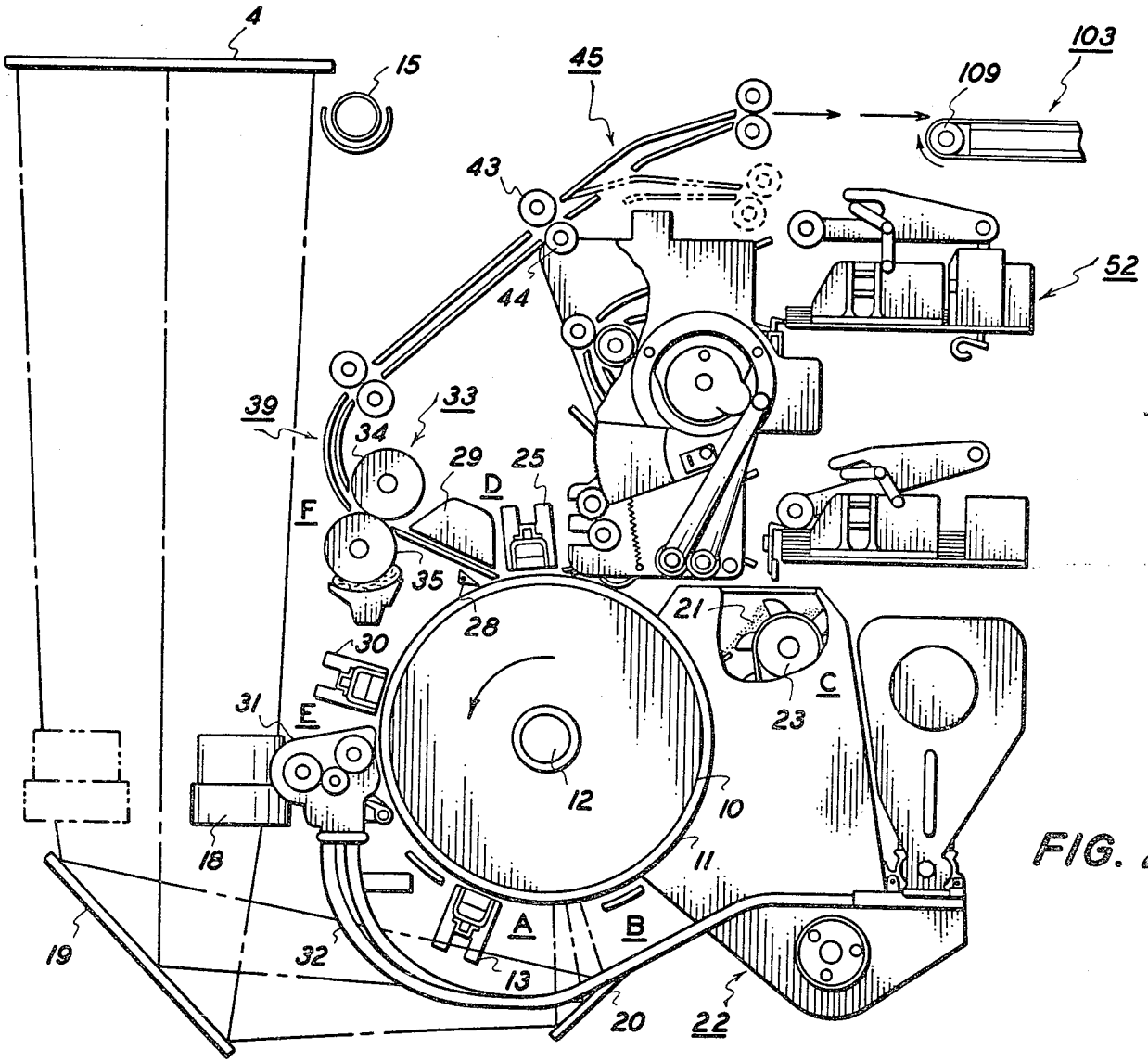
FIG. 2 is a schematic view illustrating the xerographic components of the copier/duplicator system.

As best shown in FIG. 2, the copier/duplicator system includes an automatic xerographic apparatus which includes a photosensitive plate including a photoconductive layer 10 that is placed over a conductive backing. The plate is formed in the shape of a drum 11 and the drum mounted upon a shaft 12 that is journaled for rotation in the machine frame. Basically, the xerographic drum is rotated in the direction indicated so as to pass sequentially through a series of xerographic processing stations. The photosensitive drum and the xerographic processing apparatus are driven at predetermined speeds relative to each other from a drive system (not shown) and the operations thereof coordinated in order to produce proper cooperation of the various processing mechanisms.

The original, to be reproduced, is placed upon a transparent horizontally supported platen 4 and the original scanned by means of a moving optical scanning system and to produce a flowing light image of the original. The scanning system includes an elongated horizontal extended aperture lamp 15 and a movable lens element 18. The lamp and lens element moves in coordination across the object supported upon the platen to focus successive incremental bans of illumination reflected from the object onto the moving drum surface at synchronous speeds therewith. The optical path is folded by means of a pair of image mirrors 19 and 20 interposed between the lens and the drum surface, the drum is first uniformly charged by means of a corona generator 13 positioned in charging Station A. Under the influence of the flowing light image, the uniformly charged photoconductive surface is selectively dissipated in the non-image areas to form what is commonly known as a "latent electrostatic image".

The latent electrostatic image is carried on the drum surface from the exposure station into the developing station C. The developing station primarily is comprised of a developer housing 22 adapted to support a supply of two-component developer material 21 therein. The developer material is transported by means of a bucket system 23 from the bottom of the developer housing to an elevated position where the material is delivered into the active development zone. The developer material is caused to flow downwardly in contact with the upwardly moving drum surface under closely controlled conditions wherein charged toner particles are attracted from the developer mix into the image areas on the plate surface thus making the image visible.

The moving drum surface next transports the developed xerographic image to a transfer station D. Cut sheets of final support material are also moved into the transfer station, the backside of the copy sheet is sprayed with an ion discharge from a transfer corotron 25 inducing on the sheet a charge having a polarity and magnitude sufficient to attract the toner material from the drum surface to the final support material. The induced charge also electrostatically tacks the final support material to the drum surface. In order to remove the copy sheet from the drum surface, a stripper finger 28 is positioned downstream from the transfer corotron. The finger is arranged to move between the drum surface and the copy sheet and lifts the sheet from the drum surface and the copy sheet is directed along a predetermined path of travel into contact with a stationary vacuum transport 29.

Although a preponderance of the toner material is transferred from the drum surface to the copy sheet during the transfer process, invariably some residual toner remains behind on the drum surface after transfer. This residual toner is transported on the drum surface after transfer. The residual toner is transported on the drum surface into a cleaning station E where it is brought under the influence of cleaning corotron 30 adapted to neutralize the electrostatic charge tending to hold the residual toner to the drum surface. The neutralized toner is mechanically cleaned from the drum surface by means of a brush or the like and the toner collected within a housing 31. A conveyor moving in an endless loop through tubes 32 transport the collected residual toner back to the developer housing where it is deposited within the developer mix so that it can be once again reused in the xerographic developing process.

The copy sheet, which has been removed from the drum surface after the transfer operation, is moved along stationary transport 29 into fusing station F. The fuser 33 is basically made up of an upper fuser roll 34 and a lower fuser roll 35 mounted in operative relation to each other and arranged to coact so as to support a sheet of material in pressure driving contact therebetween. The lower roll is heated. As the heated roll is rotated in the direction indicated, the heated surface of the lower roll is pressed into intimate contact with the image face of the support sheet. Mechanical and heat energy transported from the roll surface to the support sheet to permanently bond the toner particles to the support material.

Upon leaving the fuser, the fixed copy sheet is passed through a curvalinear sheet guide system, generally referred to as into cooperating advancing rolls 43 and 44. At this point, depending on the mode of operation selected, the copy sheet is either forwarded directly to the sorter or into the upper supply tray 52 by means of a movable sheet guide 45 before entering the sorter.

It is believed that the foregoing description is sufficient for purposes of the present application to show the general operation of a xerographic reproducing machine. For a more detailed explanation of the copier/duplicator xerographic components reference is made to U.S. Pat. No. 3,645,615, entitled Copying Apparatus.

SORTING APPARATUS

Sorter apparatus 6 comprises a horizontal vacuum transport assembly 103 which receives copy sheets from the copier/duplicator and advances them to a plurality of tray assemblies 7. A drive apparatus moves the tray assemblies vertically intermittently for receiving copy sheets advanced along the transport path as will be explained hereinafter. A drive motor 111 serves to drive transport assembly 103 which uses vacuum generated by a blower 108.

The tray assemblies 7 are arranged in groups of approximately five (5) trays each for purposes of multiple bin unloading as will become more apparent. Each of the tray assemblies has a tray portion 205 which is inclined at an angle of approximately 20° to the horizontal and an end portion 207 which is perpendicular to the tray portion 205 and then extends in a horizontal direction at tail portion 209. Tray portion 205 and tail portion 209 are mounted on cam followers which engage the spiral slot formed in the cylindrical surface of cam members to be described.

Tail portion 209 has a cam follower mounted 213 which includes a spring member 215 for enabling movement of the cam follower 213 relative to the tray assembly 203. Tray portion 205 has a pair of cam followers 211 mounted adjacent the leading corners thereof and received in spiral grooves 221 of camming members 223 and 224 positioned at opposite sides of the entrance to the tray assembly. A third cam member 225 which has spiral portions 227 for receiving cam follower 213. By this arrangement, a three point suspension is provided by the tray assemblies.

Each of the cam members 223 and 224 at the entrance of the tray assemblies and cam member 225 at the rear of the tray assemblies have the same path. The path has a series of fine closely spaced or low pitch surfaces 231 separated by a high pitch surface 233 providing separation of the tray assemblies into groups to enable multiple bin unloading. It will be noted that by this arrangement that multiple bin unloading results in copy sets in adjacent tray assemblies being offset about ¼ inch such that set separations of sets or books is effected upon simultaneous unloading of a group of the tray assemblies (FIG. 7). Also by the above arrangement, the tray assemblies compact in space in a series of nested arrangements, to enable getting a large number of trays into a confined area.

At the vicinity of sheets entering the sorter is a very high pitch portion 235. The construction of the cam members 223, 224, and 225 with pitch portion 235, renders an opening tray or bin feature as each of the tray assemblies passes the horizontal transport which moves the copy sheets into each of the tray assemblies. By this structure, as the tray assemblies pass the horizontal transport, there is an opening movement between the tray assemblies greatly facilitating receipt of copy sheets into them. The tray assemblies then close to the normal gap from the previous tray assembly. It has been found that this opening bin feature, makes less difficult the movement of the copy sheets, into the moving tray assemblies, even where large stacks of paper are received in the tray assemblies to enable a reliable trouble free operation. At the same time, by virtue of the sorter construction, a great number of tray assemblies can be used in a relatively small area. Moreover, the construction of the cam members enables receiving a high volume of sheets in a tray assembly.

The drive mechanism for moving the tray assemblies vertically includes a drive motor 250 which drives three timing belts 251, one each for the cam members 223, 224, and 225. Torque is transmitted to each of the cam members by a pulley associated with each of the cam members by a pulley associated with each of the timing belts 251. The cam members may be made out of any suitable material such as "Delrin", a trademark of Du-Pont Corporation, Wilmington, Delaware. The drive motor 250, is energized intermittently by electrical signals supplied by machine control when sheets on transport assembly 105 are detected by a lamp and photocell sensing unit 253 with the aid of a reflector 255 FIG. 6. One or more switches 256 are mounted near cam member 233 to control de-engerization of motor 250 upon a single revolution of the cam member. Also limit switches 257 are provided to detect the upper and lower limits of the path of the tray assemblies to reverse the direction of motor 250.

Figure 4:
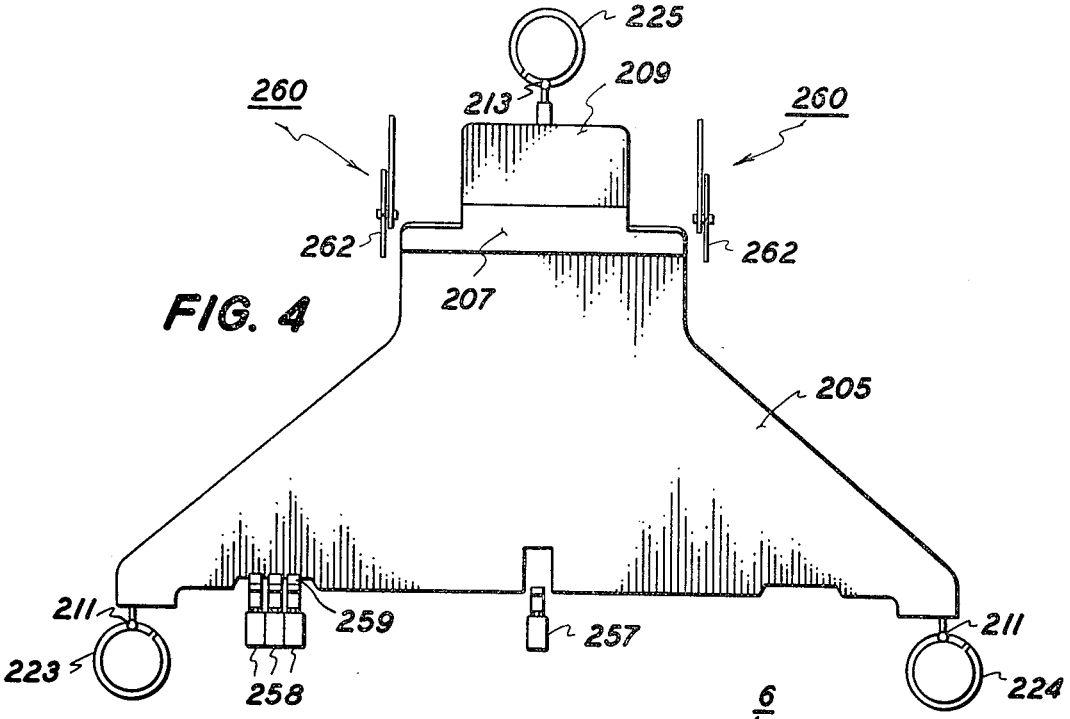
FIG. 4 is a plan view of the tray assemblies.

In accordance with the present invention to insure that the sheets in the tray assemblies are neatly stacked in a pile, a sheet stacking apparatus 260 is positioned on the frame adjacent to the discharge zone. As best shown in FIG. 8, sheets entering the tray assemblies have a tendency to curl along tray portion 207 thereby forming an obtuse angle therewith as soon as one sheet enters. This is especially prevalent in extreme environmental conditions, such as high and low humidity. The sheet stacking apparatus 260 FIGS. 9*a* and 9*b* comprises a pair of light weight plate members 260 and 262 each positioned at one side of the sheet discharge zone best seen in FIG. 4. Since each of the plate members has the same structure only one will be described, it being appreciated that both cooperate to perform the necessary function and result.

The plate member has connecting linear side portions 264–269. When the tray assembly is empty, it will be noted that side portion 264 forms an acute angle $\theta_1$ with tray portion 205. The plate member is pivotally mounted on a pin member 271 on the frame. When an incoming sheet strikes the plate member the kinetic energy is transformed to rotary kinetic energy. As the plate member returns to its normal rest position, its rotational kinetic energy acts on all the sheets in the stack of the tray assembly. As a result the top sheet is precluded from moving relative to the stack and the tray assembly. As the sheets fill the tray assembly FIG. 9*b* an acute angle $\theta_2$ being formed by the top most sheet and the side portion 264 decreases gradually as plate member pivots slowly away from the sheet edges stacking against tray portion 207.

Figure 3:
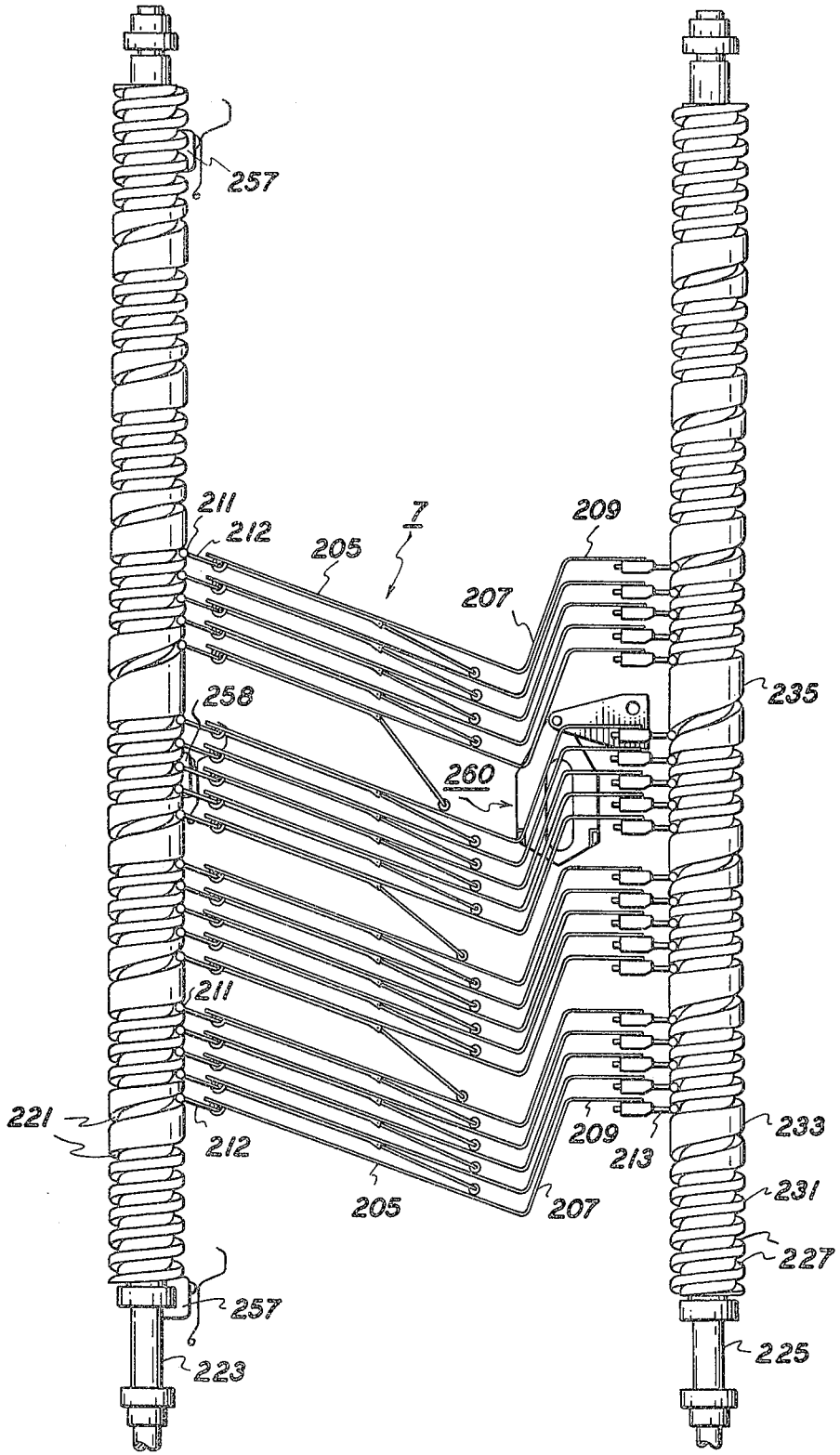
FIG. 3 is an elevation view of the tray assemblies.

In operation the plate member becomes the effective tray back to prevent the sheets from curling. The plate member is sufficiently light in weight that the sheet actually follows tray portion 207. Any suitable material can be used for plate member such as plastic. It will now be appreciated that the plate member transforms kinetic energy which is absorbed by the topmost portion of stack thereby preventing the plate member from pushing the top sheet away from the stack. As a result sheet skew and bounce are minimized as sheets enter the tray assemblies. To assist in preventing sheet movement each tray assembly is provided with rollers 280 FIGS. 3 and 5 which are hinged to an adjacent tray assembly.

By the above described invention a stacking apparatus is provided which is effective over a wide range of sheet weights. Thus the rotational displacement of the plate members vary with the weight of the sheets with the heavier sheets having greater kinetic energies and therefor greater rotational displacement. With the present invention sheets are stacked neatly in trays to facilitate unloading of the stack.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. In a sorting apparatus in which copy sheets are sorted into tray members moved past a sheet path, wherein each tray member is arranged with a first tray portion inclined to the horizontal plane on which sides of copy sheets are received and a second tray portion against which edges of the copy sheets are received, the improvement comprising:

a frame, at least two light weight plate members positioned on said frame in spaced relation with at least one plate member on each side of the center line of the sheet path and terminating the sheet path at an acute angle to said first tray portion, said plate members being pivotable on an axis parallel to and adjacent said second tray portion to move relative to the tray member whereby a copy sheet entering the tray member strikes said plate members transferring kinetic energy to rotational kinetic energy which is absorbed by the topmost sheets in said tray member upon return of said plate members to a rest position, wherein each of said plate members is in the shape of a polygon which is relatively thin, said polygon having a leading edge in the sheet path forming said acute angle with said first tray portion, wherein said acute angle decreases as the tray member fills with copy sheets whereby curling of sheets along said second tray portion is minimized.

2. In a sorting apparatus in which copy sheets are sorted into tray members moved past a sheet path, wherein each tray member is arranged with a first tray portion inclined to the horizontal plane on which sides of copy sheets are received and a second tray portion against which edges of the copy sheets are received, the improvement comprising:

a frame, at least one light weight plate member located on said frame at the termination of the sheet path at an acute angle to said first tray portion, said plate member being pivotable on an axis parallel to and adjacent to said second tray portion to move relative to the tray member whereby a copy sheet entering the tray member strikes said plate member transferring kinetic energy to rotational kinetic energy which is absorbed by the topmost sheets in said tray member upon return of said plate member to its rest position, wherein said plate member is in the shape of a polygon which is relatively thin, said polygon having a leading edge in the sheet path forming said acute angle with said first tray portion, wherein said acute angle decreases as the tray member fills with copy sheets whereby curling of sheets along said second tray portion is minimized.

* * * * *